United States Patent [19]

Nagaoka et al.

[11] Patent Number: 4,983,485

[45] Date of Patent: Jan. 8, 1991

[54] POSITIVELY CHARGEABLE TONER

[75] Inventors: Takeshi Nagaoka, Higashi-matsuyama; Takashi Yoshioka, Tsurugashima; Kazuo Kamagata, Hatoyama; Natsuo Sawa, Tadotsu; Takayuki Murai, Sakado, all of Japan

[73] Assignee: Shikoku Chemicals Corporation, Japan

[21] Appl. No.: 337,902

[22] Filed: Apr. 11, 1989

[30] Foreign Application Priority Data

| | | | |
|---|---|---|---|
| Apr. 13, 1988 | [JP] | Japan | 63-91989 |
| Apr. 15, 1988 | [JP] | Japan | 63-94281 |
| Feb. 13, 1989 | [JP] | Japan | 1-34175 |
| Feb. 17, 1989 | [JP] | Japan | 1-39143 |

[51] Int. Cl.[5] ..... G03G 9/00

[52] U.S. Cl. ..... 430/110; 430/109

[58] Field of Search ..... 430/109, 110

[56] References Cited

U.S. PATENT DOCUMENTS 4,122,060 10/1978 Yallourakis ..... 523/429

FOREIGN PATENT DOCUMENTS 5065962 5/1980 Japan .
0185349 10/1984 Japan ..... 430/110
1259265 11/1986 Japan ..... 430/110
1294461 12/1986 Japan ..... 430/109
2264066 11/1987 Japan .

*Primary Examiner*—Marion E. McCamish
*Assistant Examiner*—S. Crossan
*Attorney, Agent, or Firm*—Sherman & Shalloway

[57] ABSTRACT

Disclosed is a positively chargeable toner comprising, as a charge-controlling agent, an acid adduct, metal complex or derivative of a 2-alkylimidazole represented by the following formula:

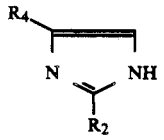

wherein $R_2$ stands for an alkyl group having 11 through 17 carbon atoms, and $R_4$ stands for a hydrogen atom or a methyl group.

In this toner, a high charge-controlling effect is attained with a small amount of the charge-controlling agent, and since the charge-controlling agent has a white color or light color, this toner is advantageously used as an electrostatic photographic toner for the color printing.

11 Claims, No Drawings

POSITIVELY CHARGEABLE TONER

BACKGROUND OF THE INVENTION

1. Field of the Invention

The present invention relates to a positively chargeable toner which is used for developing an electrostatic latent image in the electrophotographic process or the electrostatic printing process.

2. Description of the Related Art

Toners for developing electrostatic latent images are generally prepared by dispersing a colorant such as a dye or a pigment and a charge-controlling agent for imparting a positive or negative chargeability in a binder resin such as a styrene resin, an epoxy resin or a polyester resin and finely pulverizing the composition to an average particle size of about 10 to about 15 μm.

As the special preparation process, there are known a process in which a pigment or charge-controlling agent is stuck to the surfaces of particles composed of a binder resin by utilizing a mechanochemical reaction, and a process in which a pigment and a charge-controlling agent are dispersed in a monomer as the starting material of a binder resin and a spherical toner is prepared by a suspension polymerization reaction.

As the charge-controlling agent customarily used for a positively chargeable toner, there are known Nigrosine dyes, quaternary ammonium salts and metal salts of higher fatty acids.

As the process in which an imidazole is used for a toner for developing an electrostatic latent image, there are known a process in which 2-aminobenzoimidazole is used as the negative charge-controlling agent (see Japanese Patent Application Laid-Open Specification No. 217055/86 and Japanese Patent Application Laid-Open Specification No. 259265/86), a process in which vinylimidazole is used as the outer shell of a capsule toner (see Japanese Patent Application Laid-Open Specification No. 187350/84) and a process in which an epoxy resin is used as the binder resin of a toner and an imidazole is used as the curing agent (see Japanese Patent Application Laid-Open Specification No. 294461/86 and Japanese Patent Application Laid-Open Specification No. 242960/87).

Of known positive charge-controlling agents, a Nigrosine dye is poor in the durability of the charge-controlling effect and has a black color, and this charge-controlling agent is not suitable for a color toner other than a black toner.

Furthermore, a quaternary ammonium salt or a metal salt of a higher fatty acid has a white color or a light color, and therefore, this charge-controlling agent is advantageously used for a color toner. However, since this charge-controlling agent is poor in the charge-controlling effect, a large charge quantity cannot be obtained by addition of a small amount of the charge-controlling agent.

SUMMARY OF THE INVENTION

It is therefore a primary object of the present invention to provide a positive charge-controlling agent, which has a white or light color suitable for not only a toner for black printing but also a toner for color printing and which shows a high charge-controlling effect with a small amount added of the charge-controlling agent.

Under the above-mentioned background, we made research works and investigations and as the result, it was found that an acid adduct, metal complex or derivative of a 2-alkylimidazole compound represented by the following formula has an excellent charge-controlling capacity:

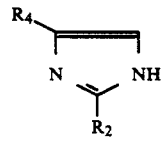

wherein $R_2$ stands for an alkyl group having 11 through 17 carbon atoms, and $R_4$ stands for a hydrogen or a methyl group. We have now completed the present invention based on this finding.

More specifically, in accordance with the present invention, there is provided a positively chargeable toner which comprises, as a charge-controlling agent, an acid adduct, metal complex or derivative of a 2-alkylimidazole represented by the following general formula:

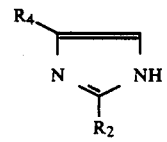

wherein $R_2$ stands for an alkyl group having 11 through 17 carbon atoms and $R_4$ stands for a hydrogen atom or a methyl group.

DETAILED DESCRIPTION OF THE PREFERRED EMBODIMENT

An acid adduct of the 2-alkylimidazole compound suitably used for carrying out the present invention is represented by the following formula:

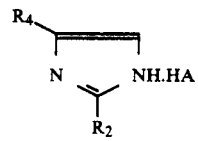

wherein $R_2$ and $R_4$ are as defined above, HA stands for inorganic acid or organic acid.

This acid adduct is prepared by mixing a 2-alkylimidazole prepared by the process disclosed in Japanese Patent Publication No. 26405/64, with an inorganic acid or organic acid in water or an organic solvent, cooling the reaction product and recovering the precipitated crystal by filtration.

As typical instances of the acid adduct of the 2-alkylimidazole, there can be mentioned hydrochlorides, hydrobromides, sulfates, nitrates, phosphates, phosphites, laurates, palmitates, stearates, glycolates, lactates, oxalates, malonates, succinates, adipates, maleates, fumarates, tartrates, p-nitrobenzoates, isophthalates, terephthalates, trimellitates and pyromellitates of 2-undecylimidazole, 2-undecyl-4-methylimidazole and 2-heptadecylimidazole.

Various metal complexes of 2-alkylimidazoles differing in the bonding structure can be suitably used for carrying out the present invention. As typical instances, there can be mentioned imidazole-metal complexes represented by the following formula:

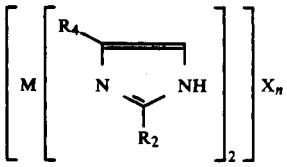

wherein $R_2$ and $R_4$ are as defined above, M stands for a metal of the group IB, IIB or VIII, X stands for an anion, and n is 1 or 2, and imidazole-metal complexes represented by the following formula:

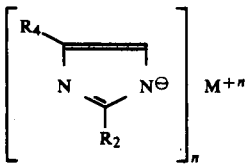

wherein $R_2$, $R_4$ and M are as defined above, and n represents the valency of the metal M.

The former imidazole-metal complex (hereinafter referred to as "metal complex A") can be synthesized by reacting a 2-alkylimidazole compound with a metal salt in an organic solvent at room temperature or under heating. As the metal salt, there can be used halides, nitrates, sulfates and organic acid salts, such as acetates, of silver, copper, cadmium, zinc, mercury, nickel and cobalt. Of these metal salts, hydrochlorides of copper, zinc, nickel and cobalt are especially preferred. Some of metal complexes A are viscous liquids at normal temperature, and they are not suitable as the charge-controlling agent. A complex having a melting point higher than 50° C., an excellent heat stability and a low hygroscopicity is preferred.

Some metal complexes A have a sharp color according to the kind of the metal ion, and these metal complexes are especially preferred as a charge-controlling agent acting also as a colorant for a color toner.

The latter imidazole-metal complex (hereinafter referred to as "metal complex B") can be synthesized, for example, by treating the metal complex A with an alkaline substance.

More specifically, a metal complex B, such as $(C_{11}Z)_2Zn$ (having a melting point higher than 250° C.) can be synthesized by dissolving a metal complex A $[Zn(C_{11}Z)_2]Cl_2$ (having a melting point of 89° to 92° C.) obtained from 2-undecylimidazole ($C_{11}Z$) and zinc chloride in methanol and adding a slight excess of a solution of sodium hydroxide to the formed solution with stirring.

The metal complex B is not molten even if it is heated above 200° C., and is insoluble in water and almost all of organic solvents. Furthermore, the metal complex B has a low hydgroscopicity. Accordingly, the metal complex B is especially preferred as the charge-controlling agent.

As the metal complex of an imidazole compound having a long-chain alkyl group at the 2-position of the imidazole zinc, complexes having 2-amylimidazole, 2-heptylimidazole, 2-undecylimidazole, 2-dodecylimidazole, 2-tridecylimidazole, 2-tetradecylimidazole, 2-heptadecylimidazole, 2-undecyl-4-methylimidazole or 2-heptadecyl-4-methylimidazole as the ligand are suitable for the practical application. It has been confirmed that of these compounds, an imidazole compound having an alkyl group having 11 to 17 carbon atoms, especially an undecyl or heptadecyl group, at the 2-position has an excellent positive charge-controlling capacity.

As the 2-alkylimidazole derivative suitable for carrying out the present invention, there can be mentioned a 2,4-diamino-6-imidazolylethyl-s-triazine compound represented by the following formula:

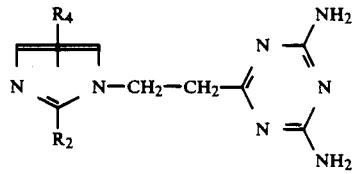

wherein $R_2$ and $R_4$ are as defined above.

This derivative can be prepared by reacting a 2-alkylimidazole with acrylonitrile and reacting the obtained 1-cyanoethyl-2-alkylimidazole compound with dicyandiamide in a protonic solvent (see Japanese Patent Publication No. 36391/72).

As typical instances, there can be mentioned 2,4-diamino-6-[2'-undecylimidazolyl-(1')]ethyl-s-triazine, 2,4-diamino-6-[2'-heptadecylimidazolyl-(1')]-ethyl-s-triazine, 2,4-diamino-6-[2'-undecyl-4'-methylimidazolyl-(1')]ethyl-s-triazine, 2,4-diamino-6-[2'-undecyl-5'-methylimidazolyl-(1')]ethyl-s-triazine, and mixtures of two or more of the foregoing compounds.

As the other 2-alkylimidazole derivative suitable for carrying out the present invention, there can be mentioned a 4,4'-methylene-bis-(2-alkylimidazole) represented by the following formula:

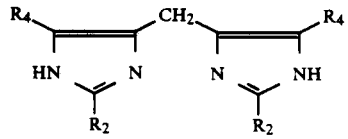

wherein $R_2$ and $R_4$ are as defined above.

This derivative can be prepared by reacting a 2-alkylimidazole compound with paraformaldehyde under heating (see Japanese Patent Publication No. 41911/86). 4,4'-Methylene-bis-(2-undecyl-5-methylimidazole) can be mentioned as a typical instance.

In the positively chargeable toner of the present invention, the acid adduct, metal complex or derivative of the 2-alkylimidazole should be incorporated in an amount of 0.1 to 10% by weight, preferably 0.5 to 5.0% by weight, based on the toner. If the amount incorporated of the charge-controlling agent is too small, the charge quantity of the toner becomes insufficient. If the amount incorporated of the charge-controlling agent is too large, the charge quantity of the toner changes with the lapse of time and the charge-controlling effect becomes unstable.

In carrying out the present invention, a known positive charge-controlling agent such as a Nigrosine dye, a quaternary ammonium salt or a metal salt of a higher fatty acid can be used in combination with the imidazole compound of the present invention.

A styrene/acrylic acid ester copolymer is a typical instance of the binder resin suitable for carrying out the present invention. Furthermore, there can be used a polystyrene resin, an acrylic resin, a polypropylene resin, a polyethylene resin, a polyamide resin, a polyurethane resin, a phenolic resin, a polyester resin and a polycarbonate resin. Mixtures of two or more of these binder resins can also be used.

Known various colorants can be used as the colorant in the present invention. For example, in case of a black toner, carbon black and a Nigrosine dye can be used, and in case of a red toner, a Rhodamine pigment or a quinacridone pigment can be used. In case of a blue toner, a copper phthalocyanine pigment and an anthracene derivative dye can be used, and in case of a yellow toner, there can be used Benzidine Yellow.

The positively chargeable toner of the present invention can also be used as a magnetic toner by incorporating a magnetic material. As the magnetic material to be added for formation of the magnetic toner, there can be mentioned iron oxides such as magnetite, hematite and ferrite, metals such as iron, cobalt and nickel, and alloys containing these metals. The magnetic material has preferably an average particle size of about 0.1 to 2 μm, and it also is preferred that the magnetic material be incorporated in an amount of 40 to 150 parts by weight per 100 parts by weight of the binder resin component of the toner.

In carrying out the present invention, known additives for improving the image characteristics can be incorporated in addition to the above-mentioned imidazole compound. For example, a flow modifier such as colloidal silica, an abrasive such as strontium titanate or silicon carbide, a lubricant such as a metal salt of stearic acid and a conducting agent such as tin oxide can be added.

The positively chargeable toner of the present invention can be prepared according to a known process. As the most typical process, there can be mentioned a process in which the imidazole compound, colorant and other additives are appropriately incorporated into the binder resin, the mixture is sufficiently kneaded by a hot roll, a kneader or an extruder, the kneaded mixture is roughly pulverized and finely pulverized, and particles having a particle size smaller than 45 μm, preferably 4 to 20 μm, are collected to prepare a toner having an average particle size of 10 to 15 μm.

The present invention will now be described in detail with reference to the following examples and comparative examples.

In these examples, the styrene/acrylic acid ester copolymer (binder resin) was S-708F supplied by Fujikura Kasei, and carbon black #40 (supplied by Mitsubishi Chemical Industries, Ltd.; neutral type) (hereinafter referred to as "CB-1"), carbon black MA100 (supplied by Mitsubishi Chemical Industries, Ltd.; acidic type) (hereinafter referred to as "CB-2") and a phthalocyanine type blue pigment (Lionol Blue FG7330 supplied by Toyo Ink) (hereinafter referred to as "F") were used as colorant. The amounts of components of toners were expressed by units of parts by weight.

EXAMPLES 1 TO 17

A styrene/acrylic acid ester copolymer resin was used as the binder resin, carbon black or a phthalocyanine blue pigment was used as the colorant, and an acid adduct of a 2-alkylimidazole represented by the following formula:

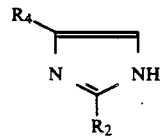

was used as the charge-controlling agent. These binder resin, colorant and charge-controlling agents were mixed at a ratio shown in Table 1 and dry-blended by a small-size mixer. Then, the mixture was kneaded at a temperature of 130° to 160° C. by a twin-screw extruder. The extrudate was then cooled and the formed plate was roughly pulverized in a mortar and finely pulverized under cooling by a desk pulverizer. Then, the pulverization product was passed through a stainless steel sieve having a mesh size of 44 μm to obtain a sample toner.

The composition of the sample toner and the kind of the carrier used are shown in Table 1.

TABLE 1

| Example No. | Amount of Binder Resin | Imidazole Compound (Acid Adduct) | | | | | Colorant | | Carrier |
|---|---|---|---|---|---|---|---|---|---|
| | | $R_2$ | $R_4$ | acid (molar ratio*) | | amount | kind | amount | |
| 1 | 100 | $nC_{17}H_{35}$ | H | hydrochloric acid | (1:1) | 5 | CB-1 | 5 | iron powder |
| 2 | 100 | " | " | sulfuric acid | (1:1) | 2 | " | 5 | " |
| 3 | 100 | " | " | sulfuric acid | (2:1) | 5 | " | 5 | " |
| 4 | 100 | $nC_{11}H_{23}$ | " | phosphoric acid | (1:1) | 2 | " | 5 | " |
| 5 | 100 | $nC_{17}H_{35}$ | " | stearic acid | (1:1) | 5 | " | 5 | " |
| 6 | 100 | " | " | oxalic acid | (1:1) | 5 | " | 5 | " |
| 7 | 100 | " | " | " | (2:1) | 5 | " | 5 | " |
| 8 | 100 | $nC_{11}H_{23}$ | " | " | (1:1) | 2 | " | 5 | " |
| 9 | 100 | " | " | " | (2:1) | 5 | " | 5 | " |
| 10 | 100 | " | $CH_3$ | " | (1:1) | 5 | " | 5 | ferrite |
| 11 | 100 | $nC_{17}H_{35}$ | H | fumaric acid | (1:1) | 5 | " | 5 | iron powder |
| 12 | 100 | " | " | " | (2:1) | 5 | " | 5 | " |
| 13 | 100 | $nC_{11}H_{23}$ | " | " | (1:1) | 2 | " | 5 | " |
| 14 | 100 | $nC_{17}H_{35}$ | " | trimellitic acid | (1:1) | 5 | " | 5 | " |
| 15 | 100 | $nC_{11}H_{23}$ | " | " | (1:1) | 5 | F | 5 | ferrite |
| 16 | 100 | " | $CH_3$ | " | (1:1) | 5 | CB-1 | 5 | iron powder |
| 17 | 100 | $nC_{17}H_{35}$ | H | pyromellitic acid | (1:1) | 5 | " | 5 | " |

Note: *each parenthesized value indicates the molar ratio between the imidazole compound and the acid.

A polyethylene vessel having a capacity of 100 ml was charged with 1 g of the sample toner and 25 g of a carrier (iron powder or ferrite), and the mixture was stirred and shaken on a rotating roll of a roll mill for 5 or 30 minutes and the charge quantity was measured by a blow-off type charge quantity measuring apparatus.

Iron powder (DSP-128B supplied by Dowa Teppun) or ferrite (F-150 supplied by Nippon Teppun) was used as the carrier.

The measurement of the charge quantity was carried out under conditions of a blow pressure of 1 kg/cm$^2$ and a measurement time of 25 seconds by using 200 mg of the mixture of the sample toner and carrier. The unit of the measured value is $\mu$C ($10^{-6}$ Coulomb) per gram of the sample.

The results of the measurement of the charge quantity are shown in Table 2.

TABLE 2

| Example No. | Charge Quantity ($\mu$C/g) 5 minutes | 30 minutes |
|---|---|---|
| 1 | 8.7 | |
| 2 | 6.2 | |
| 3 | 11.4 | 13.1 |
| 4 | 6.8 | 7.1 |
| 5 | 11.3 | 12.9 |
| 6 | 11.4 | |
| 7 | 12.6 | 14.1 |
| 8 | 7.0 | 8.1 |
| 9 | 9.6 | 10.8 |
| 10 | 10.3 | 10.5 |
| 11 | 12.0 | 13.6 |
| 12 | 11.4 | |
| 13 | 7.8 | 8.6 |
| 14 | 8.7 | 9.6 |
| 15 | 8.1 | |
| 16 | 8.4 | |
| 17 | 7.3 | |

EXAMPLES 18 TO 32

A toner having a composition shown in Table 3 was prepared by using a metal complex of a 2-alkylimidazole as the imidazole compound in the same manner as described in Examples 1 through 17, and the toner was mixed with a carrier shown in Table 3, the mixture was stirred and shaken for 5 or 30 minutes and the charge quantity of the toner was measured in the same manner as described in Examples 1 through 17.

The results of the measurement of the charge quantity are shown in Table 4.

TABLE 3

| Example No. | Amount of Binder Resin | Imidazole Compound chemical formula | amount | Colorant kind | amount | Carrier |
|---|---|---|---|---|---|---|
| 18 | 98 | $[Zn(C_{11}Z)_2]Cl_2$ | 2 | not added | | iron powder |
| 19 | 93 | $[Cu(C_{11}Z)_2]Cl_2$ | 2 | CB-1 | 5 | " |
| 20 | 93 | $[Co(C_{11}Z)_2]Cl_2$ | 2 | " | 5 | " |
| 21 | 93 | $(C_{11}Z)_2$ Zn | 2 | " | 5 | " |
| 22 | 01 | $(C_{11}Z)_2$ Zn | 4 | " | 5 | " |
| 23 | 93 | $(C_{11}Z)_2$ Cu | 2 | " | 5 | " |
| 24 | 93 | $(C_{11}Z)_2$ Ni | 2 | " | 5 | " |
| 25 | 93 | $(C_{17}Z)_2$ Zn | 2 | " | 5 | " |
| 26 | 91 | $(C_{17}Z)_2$ Zn | 4 | " | 5 | " |
| 27 | 92.8 | $(C_{17}Z)_2$ Zn, zinc stearate | 2 0.2 | " | 5 | " |
| 28 | 92.8 | $(C_{17}Z)_2$ Zn, zinc stearate | 2 0.2 | " | 5 | ferrite |
| 29 | 98 | $(C_{11}4MZ)_2$ Zn | 2 | not added | | iron powder |
| 30 | 93 | $Zn(C_{11}Z)_2$ $Cl_2$ | 2 | F | 5 | " |
| 31 | 93 | $(C_{17}Z)_2$ Zn | 2 | CB-1 | 5 | ferrite |
| 32 | 93 | $(C_{17}Z)_2$ Zn | 2 | CB-2 | 5 | " |

(Note) $C_{11}Z$: 2-undecylimidazole, $C_{11}4MZ$: 2-undecyl-4-methyl imidazole, $C_{17}Z$: 2-heptadecyl imidazole

TABLE 4

| Example No. | Charge Quantity ($\mu$C/g) 5 minutes | 30 minutes |
|---|---|---|
| 18 | 22.8 | |
| 19 | 6.3 | 6.8 |
| 20 | 6.0 | 6.5 |
| 21 | 12.0 | 17.4 |
| 22 | 20.5 | |
| 23 | 15.6 | |
| 24 | 16.9 | |
| 25 | 13.9 | 15.6 |
| 26 | 22.4 | |
| 27 | 19.5 | 22.3 |
| 28 | 18.5 | 20.3 |
| 29 | 24.0 | |
| 30 | 16.5 | 20.5 |
| 31 | 18.5 | 20.0 |
| 32 | 16.3 | 21.3 |

EXAMPLES 33 TO 43

A toner having a composition shown in Table 5 was prepared in the same manner as described in Examples 1 through 17 except that a 2,4-diamino-6-imidazolyl-s-triazine compound represented by the following formula was used as the imidazole compound:

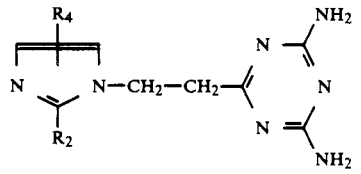

Incidentally, in Examples 41, 42 and 43, a mixture of an isomer having a methyl group at the 4-position of the imidazole ring and an isomer having a methyl group at the 5-position was used as the imidazole compound.

The composition of the toner and the carrier used are shown in Table 5.

TABLE 5

| Example No. | Amount of Binder Resin | Imidazole Compound $R_2$ | $R_4$ | amount | Colorant kind | amount | Carrier |
|---|---|---|---|---|---|---|---|
| 33 | 93 | n-$C_{11}H_{23}$ | H | 2 | CB-1 | 5 | iron powder |
| 34 | 92 | " | H | 3 | " | 5 | iron powder |
| 35 | 90 | " | H | 5 | " | 5 | iron powder |
| 36 | 90 | " | H | 5 | " | 5 | ferrite |
| 37 | 90 | " | H | 5 | F | 5 | iron powder |
| 38 | 93 | n-$C_{17}H_{35}$ | H | 2 | CB-1 | 5 | iron powder |
| 39 | 90 | " | H | 5 | " | 5 | iron powder |
| 40 | 90 | " | H | 5 | F | 5 | iron powder |
| 41 | 93 | n-$C_{11}H_{23}$ | $CH_3$ | 2 | CB-1 | 5 | iron powder |
| 42 | 92 | " | " | 3 | " | 5 | iron powder |
| 43 | 90 | " | " | 5 | " | 5 | iron powder |

In the same manner as described in Examples 1 through 17, the toner was mixed with a carrier shown in Table 5, the mixture was stirred and shaken for 5 or 30 minutes and the charge quantity was measured. The results of the measurement of the charge quantity are shown in Table 6.

TABLE 6

| Example No. | Charge Quantity (μc/g) 5 minutes | 30 minutes |
|---|---|---|
| 33 | 6.1 | 6.2 |
| 34 | 9.8 | 10.1 |
| 35 | 16.5 | 16.9 |
| 36 | 18.4 | 18.6 |
| 37 | 15.9 | 16.4 |
| 38 | 7.5 | |
| 39 | 17.1 | 17.4 |
| 40 | 20.1 | 21.1 |
| 41 | 7.1 | |
| 42 | 7.8 | 8.0 |
| 43 | 13.4 | 13.8 |

EXAMPLES 44–47

In the same manner as described in Examples 1 through 17, a composition having a composition shown in Table 7 was prepared by using 4,4'-methylene-bis-(2-undecyl-5-methylimidazole) as the imidazole compound.

Then, in the same manner as described in Examples 1 through 17, the toner was mixed with a carrier shown in Table 7, the mixture was stirred and shaken for 5 or 30 minutes, and the charge quantity of the toner was measured. The results of the measurement of the charge quantity are shown in Table 8.

TABLE 7

| Example No. | Amount of Binder Resin | Amount of imidazole compound | Colorant kind | amount | Carrier |
|---|---|---|---|---|---|
| 44 | 93 | 2 | CB-1 | 5 | iron powder |
| 45 | 93 | 2 | " | 5 | ferrite |
| 46 | 98 | 2 | — | | iron powder |
| 47 | 93 | 2 | F | 5 | " |

TABLE 8

| Example No. | Charge Quantity (μC/g) 5 minutes | 30 minutes |
|---|---|---|
| 44 | 14.3 | 18.2 |
| 45 | 18.6 | 22.3 |
| 46 | 20.9 | |
| 47 | 20.3 | |

COMPARATIVE EXAMPLES 1 THROUGH 3

A toner having a composition shown in Table 9 was prepared in the same manner as described in Examples 1 through 17 except that a commercially available quaternary ammonium salt type charge-controlling agent (BONTRON P-51 supplied by Orient Kagaku Kogyo) was used instead of the imidazole compound. Then, in the same manner as described in Examples 1 through 17, the toner was mixed with a carrier shown in Table 9, the mixture was stirred and shaken for 5 or 30 minutes, and the charge quantity was measured. The results of the measurement of the charge quantity are shown in Table 10.

TABLE 9

| Comparative Example No. | Amount of Binder Resin | Amount of Charge-Controlling Agent quaternary ammonium salt (commercially available product) | Colorant kind | amount | Carrier |
|---|---|---|---|---|---|
| 1 | 93 | 2 | CB-1 | 5 | iron powder |
| 2 | 91 | 4 | " | 5 | iron powder |

TABLE 9-continued

| Comparative Example No. | Amount of Binder Resin | Amount of Charge-Controlling Agent quaternary ammonium salt (commercially available product) | Colorant kind | Colorant amount | Carrier |
|---|---|---|---|---|---|
| 3 | 89 | 6 | " | 5 | iron powder |

TABLE 10

| Comparative Example No. | Charge Quantity (μC/g) 5 minutes | 30 minutes |
|---|---|---|
| 1 | 5.9 | 7.8 |
| 2 | 6.2 | |
| 3 | 7.9 | 9.2 |

According to the present invention, a high charge-controlling effect can be attained by addition of a small amount of the charge-controlling agent, and since the charge-controlling agent has a white color or a light color, the toner of the present invention is preferably used as an electrostatic photographic toner for the color printing.

We claim:

1. A positively chargeable toner comprising, as a charge-controlling agent, at least one compound selected from the group consisting of (i) an acid adduct of a 2-alkyl imidazole represented by the following formula:

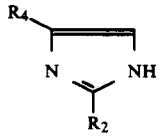

wherein $R_2$ stands for an alkyl group having 11 through 17 carbon atoms, and $R_4$ stands for a hydrogen atom or a methyl group;

(ii) a metal complex of a 2-alkyl imidazole represented by the following formula:

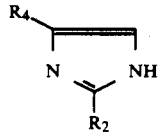

wherein $R_2$ stands for an alkyl group having 11 through 17 carbon atoms, and $R_4$ stands for a hydrogen atom or a methyl group;

(iii) a 2,4-diamino-6-imidazolylethyl-s-triazine represented by the following formula

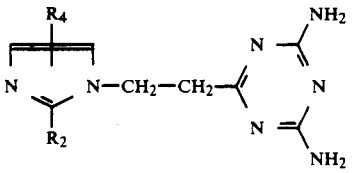

wherein $R_2$ stands for an alkyl group having 11 through 17 carbon atoms, and $R_4$ stands for a hydrogen atom or a methyl group; and (iv) a 4,4'-methylene-bis(2-alkylimidazole) represented by the following formula:

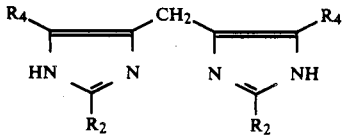

wherein $R_2$ stands for an alkyl group having 11 through 17 carbon atoms, and $R_4$ stands for a hydrogen atom or a methyl group.

2. A positively chargeable toner as set forth in claim 1, wherein the charge-controlling agent is an inorganic acid or organic acid adduct of said 2-alkylimidazole represented by the following formula:

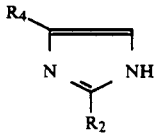

3. A positively chargeable toner as set forth in claim 1, wherein the charge-controlling agent is a metal complex of said 2-alkylimidazole represented by the following formula:

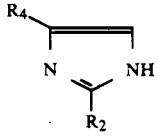

4. A positively chargeable toner as set forth in claim 3, wherein the charge-controlling agent is a metal complex of said 2-alkylimidazole represented by the following formula:

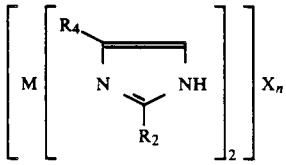

M stands for a metal of the group IB, IIB or VIII, X stands for an anion, and n is 1 or 2.

5. A positively chargeable toner as set forth in claim 3, wherein the charge-controlling agent is a metal complex of said 2-alkylimidazole represented by the following formula:

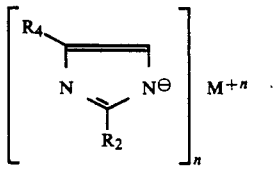

wherein M stands for a metal of the group IB, IIB or VIII, and n indicates the valency of the metal M.

6. A positively chargeable toner as set forth in claim 1, wherein the charge-controlling agent is said 2,4-diamino-6-imidazolylethyl-s-triazine represented by the following formula:

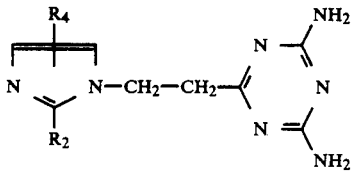

7. A positively chargeable toner as set forth in claim 1, wherein the charge-controlling agent is said 4,4'-methylene-bis(2-alkylimidazole) represented by the following formula:

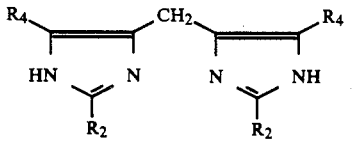

8. A positively chargeable toner which comprises, as a charge-controlling agent, an acid adduct of 2-undecylimidazole, an acid adduct of 2-undecyl-4-methylimidazole or an acid adduct of 2-heptadecylimidazole.

9. A positively chargeable toner which comprises, as a charge-controlling agent, a metal complex of 2-undecylimidazole, a metal complex of 2-undecyl-4-methylimidazole or a metal complex of 2-heptadecylimidazole.

10. A positively chargeable toner which comprises, as a charge-controlling agent, 2,4-diamino-6-[2'-undecylimidazolyl-(1')]ethyl-s-triazine, 2,4-diamino-6-[2'-undecyl-4'-methylimidazolyl-(1')]ethyl-s-triazine, 2,4-diamino-6-[2'-undecyl-5'-methylimidazolyl-(1')]-ethyl-s-triazine or 2,4-diamino-6-[2'-heptadecylimidazolyl-(1')]ethyl-s-triazine.

11. A positively chargeable toner which comprises 4,4'-methylene-bis(2-undecyl-5-methylimidazole) as a charge-controlling agent.

* * * * *